United States Patent [19]

Coupry et al.

[11] 4,345,951

[45] Aug. 24, 1982

[54] PROCESS FOR THE MANUFACTURE OF HOLLOW BODIES MADE OF ALUMINUM ALLOY AND PRODUCTS THUS OBTAINED

[75] Inventors: Jean Coupry, Voiron; Marc Anagnostidis, Chamalieres, both of France

[73] Assignee: Societe Metallurgique de Gerzat, Paris, France

[21] Appl. No.: 155,116

[22] Filed: May 30, 1980

[30] Foreign Application Priority Data

Jun. 1, 1979 [FR] France ..... 79 15054

[51] Int. Cl.[3] ..... C22F 1/04

[52] U.S. Cl. ..... 148/2; 75/141; 148/12.7 A; 148/32.5

[58] Field of Search ..... 148/2, 12.7 A, 11.5 A, 148/32, 32.5; 75/141

[56] References Cited

U.S. PATENT DOCUMENTS 4,305,763 12/1981 Quist et al. ..... 148/12.7 A

*Primary Examiner*—R. Dean

*Attorney, Agent, or Firm*—Dennison, Meserole, Pollack & Scheiner

[57] ABSTRACT

The invention relates to a process for obtaining hollow bodies made of aluminum alloy having a high bursting strength, and to the products thus obtained. The alloy contains (by weight): from 7.6 to 9.5% of Zn from 1 to 1.8% of Cu; from 2.4 to 3.5% of Mg; from 0.07 to 0.17% of Cr; from 0.15 to 0.25% of Mn; from 0.08 to 0.14% of Zr; less than 0.2% of Fe, 0.15% of Si; 0.10% of Ti; and optionally less than 0.01% of V. It has a tensile stress (lengthwise direction) and a bursting strength (transverse direction) greater than or equal to 660 MPa. Its structure is characterized by the absence of large intermetallic compounds (>35 μm) after a specific solidification test. It can be used in all the safety applications involving a container under pressure (bottles of compressed gas, etc.).

7 Claims, 2 Drawing Figures

PROCESS FOR THE MANUFACTURE OF HOLLOW BODIES MADE OF ALUMINUM ALLOY AND PRODUCTS THUS OBTAINED

This invention relates to a process for the manufacture of hollow bodies made of aluminum alloy and to the products thus obtained which have high ductility (in the lengthwise direction) and great toughness (in the transverse direction) when they are treated at levels of strength higher than 660 MPa.

It is known that the A-Z8GU (or 7049-A) alloys according to French Standard AFNOR 50-411, the analysis of which is indicated in Table I, are used in particular in the manufacture of hollow bodies under pressure due to the high mechanical characteristics which they acquire in the quenched-artificially aged state (state T6).

Now these alloys are not always reliable since premature fractures or bursting are sometimes observed during the hydraulic testing of such hollow bodies subjected to an internal pressure.

The object of this invention is therefore to solve this problem by a suitable choice partially covering the field of the 7049-A alloy which allows products having high characteristics of ductility and toughness and consequently great safety in use to be obtained.

This object is achieved:

(1) Essentially by reducing the contents of the elements Cr, Mn and Zr which are known to be recrystallization inhibitors in the Al alloys (see ALTENPOHL, "un regard a l'interieur de l'aluminium", French edition, 1976. p. 148).

Now in order to obtain the very high mechanical characteristics desired, the alloy is actually used in the nonrecrystallized state with a press effect, even after the solution treatments, quenching and artificial aging..

(2) By increasing the contents of principal elements such as Zn, Cu, Mg beyond the conventional limits.

(3) By limiting the contents of the minor elements (Fe, Si, Ti) or even the impurities such as the V to low or very low levels.

The general composition of the alloys according to the invention is as follows (by weight):

| | | |
|---|---|---|
| Zn | | 7.6 to 9.5% |
| Cu | | 1.0 to 2.0% |
| Mg | | 2.4 to 3.5% |
| Cr | | 0.07 to 0.17% |
| Mn | | 0.15 to 0.25% |
| Zr | | 0.08 to 0.14% |
| Fe | ≦ | 0.20% |
| Si | ≦ | 0.15% |
| Ti | ≦ | 0.10% |
| Others, each | ≦ | 0.05% |
| Others, total | ≦ | 0.15% |
| Remainder aluminum | | |

In a preferred composition, the V content is limited to a content of less than 0.01%.

In the process, the products are transformed in the following manner: homogenization between 460° and 490° C. of the cast billets, hot deformation at between 320° and 420° C., optionally including the reducing of one (or of both) end(s) when manufacturing hollow bodies, solution treatment at between 460° and 480° C. and artificial aging adapted so as to obtain a tensile stress (lengthwise direction) and a limit bursting stress (transverse direction) which are higher than or equal to 660 MPa.

Under these conditions and for a tensile stress of 660 MPa, the elongation in the lengthwise direction is greater than 9%. This elongation is measured over an initial length $lo=5.65\sqrt{S}$, S, being the cross-section of the sample. Hot deformation is preferably effected by backward, i.e., indirect, extrusion. The conditions for homogenization, solution treatment and artificial aging can differ from those indicated above without departing from the scope of the invention.

The bursting stress (RE) during the hydraulic test is given by the conventional formula: RE=(Dp/2e) in which e is the minimum thickness of the tube or holloy body (assumed to be substantially circular cylinder), D is the mean diameter of the cylinder, that is (D.INt.+-D.Ext./2), p is the bursting pressure.

It has been observed that the elements Cr, Mn, Zr have an unpredictable synergetic effect, that is to say their overall action on the mechanical characteristics is very much greater than the sum of the individual actions of such one of them. This effect is clearly demonstrated in the examples given below. Therefore, it was not at all obvious to select this particular combination of contents of these elements to obtain the desired properties.

The alloys according to the invention respond to the following monitoring test:

(a) Approximately 200 g of alloy are remelted at 735° C.±5° C. in a graphite crucible provided with an alumina dressing;

(b) The assembly is then subjected to slow cooling in a furnace at a rate of 0.5° to 1° C. per minute followed by holding 2 hours at a temperature 2° to 4° C. higher than that of the beginning of solidification of the alloy (liquidus), then the crucible is brought into the air to allow rapid solidification;

(c) Optical micrographic examination on a magnification of 100 to 500 of a polished sample taken from the lower half of the ingot thus obtained does not reveal any cluster of primary intermetallic constituents or of massive individual intermetallic particles greater than 35 μm in length in their greatest dimension.

The particles are considered to form part of a cluster when the distance between particles is less than or equal to the largest dimension of the particle in question. In this case, the length considered is the cumulative length of the maximum dimensions of each particle in the cluster.

Figure 1:
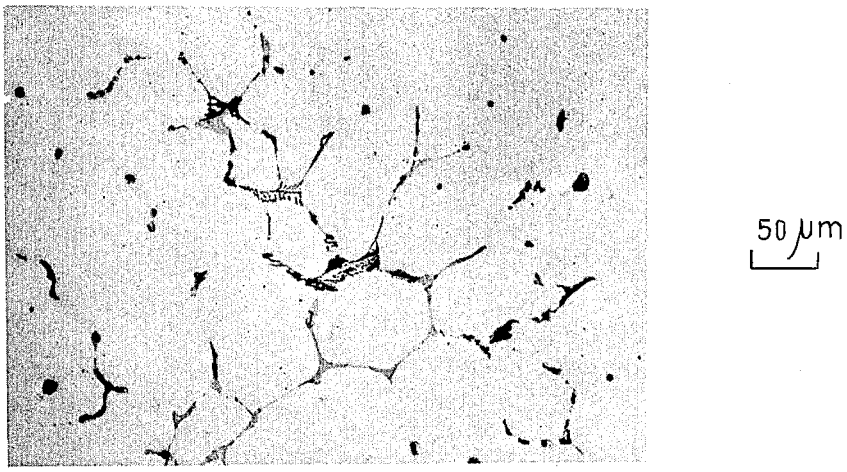
FIG. 1 is a photomicrograph, of a magnification of 200, of a sample taken from the lower third of an ingot produced in accordance with the invention.

The invention will be understood better and illustrated by the following examples:

EXAMPLE 1

The allows labeled 1 to 12, whose compositions are indicated in percent by weight in Table II, were cast semicontinuously, vertically into 185 mm diameter billets which were homogenized for 24 hours at 450° C. These billets were machined to a diameter of 170 mm and drilled with a central 70 mm diameter hole for backward extrusion of 82×67.5 mm diameter tubes at a temperature of 365° C.

The tubes were then treated in the following manner:

(i) solution treatment at 460° C. for 45 minutes (ii) cold water quenching (10°–15° C.)

(iii) artificial aging at 125° C. for 20 hours.

The tubes thus obtained were subjected to tensile tests along a direction parallel to the generatices of the tube and to bursting tests under hydraulic pressure (longitudinal tearing).

The tensile stress (Rm), yield stress (R0.2), elongation (A%) and bursting stress (RE) were measured. The results obtained are indicated in Table III.

The individual effects of the additions of 0.07% of Cr (labled A), 0.08% of Zr (labeled B) and 0.15% of Mn (labeled C) are indicated in Table IV. It is observed that the sum of the individual effects (lines A+B+C) is far less than the combined additions (line D according to the invention) of all these elements with regard to the tensile characteristics and, in a particularly spectacular way, to the yield stress and the elongations. However, there is no significant effect on the bursting stress.

The previously unpredictable synergetic effect of these elements is thus demonstrated clearly.

Moreover, it is observed that the desired characteristics are not achieved with regard to alloys 1 to 8 having a composition outside the scope of the invention, whereas the alloys 9 to 12 according to the invention achieve them.

EXAMPLE 2

Three semicontinuously casting operations of 7049 A alloy outside the limits of the composition according to the present invention were carried out. The analyses obtained are indicated in Table V.

These were transformed into tubes under the conditions adopted in Example 1 by backward, i.e., indirect, extrusion, and the tubes were end hot reduced and treated in the T-6 state by solution treatment at 465°±5° C. for 45 minutes, water quenching and artificial aging at 125° C. for 20 hours. The bursting stresses during the hydraulic test were calculated in the manner indicated above and are also shown in Table V. It can be observed that they are clearly lower than the desired limit value (660 MPa).

The following solidification test was carried out on some metal according to the invention (labeled 12, Table II) and not according to the invention (labeled E, Table V):

(1) 200 g of metal taken in continuously cast billets;

(2) melting of the sample at 735° C.±5° C.;

(3) cooling at 632° C. at a rate of 0.5° to 1° C. per minute;

(4) holding for 2 hours at 632° C. (beginning of solidification of the alloy at 628° C.);

(5) removal from furnace and rapid cooling.

With regard to an alloy according to the invention, the micrographic structure of the ingot in its lower third is represented on a magnification of 200 in FIG. 1. No compound having a size greater than 35 microns in its largest dimension is observed. Furthermore, all the compounds out of solution are observed in the interdentritic spaces. A large proportion of them is also resolved by subsequent thermal treatments.

Figure 2:
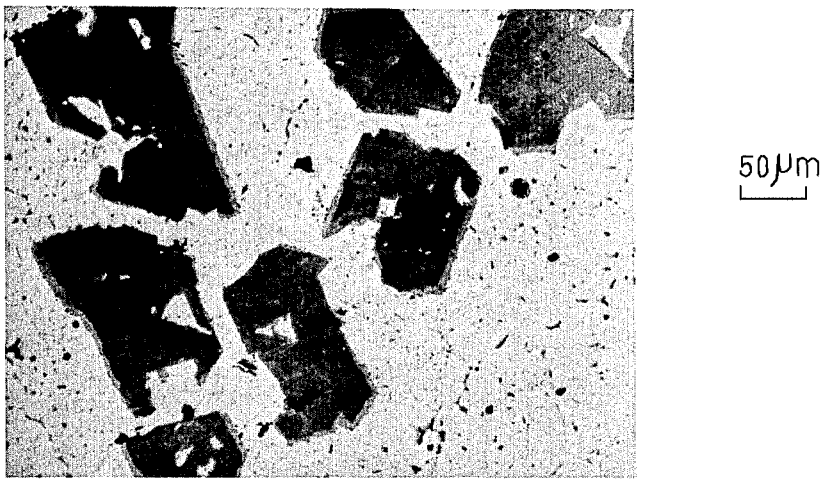
FIG. 2 is a photomicrograph, of a magnification of 200, of a sample of an alloy outside the scope of the invention, namely Cr 0.022%; Mn 0.27%; and Zr 0.13%.

On the other hand, in the case of the alloy departing from the scope of the invention (Cr 0.22%, Mn 0.27%, Zr 0.13%) it is possible to observe primary intermetallic compounds of a polyhedric shape having a size greater than 100 microns and grouped in colonies (FIG. 2). These crystals cannot be confused with those in FIG. 1 by their size, their situation or, finally, by their development during transformation. In fact, they do not undergo any modification due to the effect of thermal treatments. They are fragmented and aligned, remaining adjacent to each other, in the main direction of the deformation, with all the consequences which this configuration has on the brittleness of the product.

TABLE I

| Composition of the 7049 A alloy (in percent by weight) | | |
|---|---|---|
| Si | ≦ | 0.40% |
| Fe | ≦ | 0.50% |
| Cu | = | 1.2 to 1.9% |
| Mn | ≦ | 0.50% |
| Mg | = | 2.1 to 3.1% |
| Cr | = | 0.05 to 0.25% |
| Zn | = | 7.2 to 8.4% |
| Ti + Zr | ≦ | 0.25% |
| OTHERS | | |
| (Each) | ≦ | 0.05% |
| (total) | ≦ | 0.15% |
| (remainder) | | Al |

TABLE II

| | Chemical Composition of the Alloys | | | | | | | | |
|---|---|---|---|---|---|---|---|---|---|
| Alloys | Fe | Si | Zn | Mg | Cu | Cr | Zr | Mn | Ti |
| 1 | 0.13 | 0.06 | 8.2 | 2.75 | 1.65 | 0 | 0 | 0 | 0.07 |
| 2 | 0.13 | 0.06 | 8.1 | 2.8 | 1.62 | 0.19 | 0 | 0 | 0.07 |
| 3 | 0.13 | 0.06 | 8.1 | 2.7 | 1.6 | 0.07 | 0 | 0 | 0.07 |
| 4 | 0.13 | 0.06 | 8 | 2.7 | 1.64 | 0 | 0.08 | 0 | 0.07 |
| 5 | 0.13 | 0.06 | 7.8 | 2.8 | 1.6 | 0 | 0 | 0.15 | 0.07 |
| 6 | 0.13 | 0.06 | 8.1 | 2.65 | 1.6 | 0.07 | 0.08 | 0 | 0.07 |
| 7 | 0.13 | 0.06 | 8.1 | 2.7 | 1.65 | 0 | 0.08 | 0.15 | 0.07 |
| 8 | 0.13 | 0.06 | 8 | 2.6 | 1.7 | 0.07 | 0 | 0.15 | 0.07 |
| 9 | 0.13 | 0.06 | 8.2 | 2.6 | 1.6 | 0.07 | 0.08 | 0.15 | 0.07 |
| 10 | 0.13 | 0.06 | 8.2 | 2.69 | 1.58 | 0.07 | 0.13 | 0.25 | 0.07 |
| 11 | 0.12 | 0.06 | 8.1 | 2.70 | 1.58 | 0.13 | 0.10 | 0.15 | 0.07 |
| 12 | 0.13 | 0.06 | 8.0 | 2.65 | 1.60 | 0.13 | 0.12 | 0.15 | 0.07 |

TABLE III

| Alloy | R 0.2 MPa | Rm MPa | A % | RE MPa |
|---|---|---|---|---|
| 1 | 589 | 608 | 14.4 | 608 |
| 2 | 607 | 666 | 7.1 | 675 |
| 3 | 597 | 633 | 10 | 641 |
| 4 | 608 | 639 | 12 | 640 |
| 5 | 590 | 610 | 13 | 610 |
| 6 | 644 | 666 | 8.7 | 669 |
| 7 | 615 | 652 | 12 | 660 |
| 8 | 591 | 631 | 12 | 638 |
| 9 | 635 | 674 | 9.5 | 675 |
| 10 | 653 | 703 | 9.2 | 692 |
| 11 | 658 | 697 | 9.9 | 691 |
| 12 | 651 | 700 | 9.5 | 686 |

TABLE IV

| Label | Tests | Δ % | Δ R 0.2 (MPa) | Δ Rm (MPa) | Δ A (%) | Δ RE (MPa) |
|---|---|---|---|---|---|---|
| A | 3/1 | Cr: 0.07 | 8 | 25 | −4.4 | 34 |
| B | 4/1 | Zr: 0.08 | 19 | 31 | −2.4 | 32 |
| C | 5/1 | Mn: 0.15 | 1 | 2 | −1.4 | 2 |
| A + B + C | — | — | 28 | 58 | −8.2 | 68 |
| D (invention) | 9/1 | Cr: 0.07 + Zr: 0.08 + Mn: 0.15 | 46 | 66 | −4.9 | 67 |

TABLE V

| Casting Label | Chemical Composition (percent by weight) | | | | | | | | |
|---|---|---|---|---|---|---|---|---|---|
| | Fe | Si | Cu | Zn | Mg | Mn | Cr | Zr | (RE)* |
| E | 0.11 | 0.06 | 1.58 | 8.25 | 2.61 | 0.33 | 0.22 | 0.12 | 554 MPa 618 MPa |
| F | 0.14 | 0.07 | 1.60 | 8.21 | 2.65 | 0.27 | 0.22 | 0.13 | 591 MPa 598 MPa 623 MPa |
| G | 0.13 | 0.04 | 1.53 | 8.25 | 2.58 | 0.27 | 0.24 | 0.14 | 598 MPa 596 MPa |

*Transverse stresses at the moment of bursting

We claim:

1. A process for obtaining from an alloy in the non-recrystallized state a hollow body which is resistant to an internal pressure comprising tensile stress and bursting stress which are higher than or equal to 660 MPa and a lengthwise breaking elongation greater than or equal to 9% when tensile stress=660 MPa, comprising at least the following steps:

(a) casting a billet of an alloy essentially consisting by weight:

| | | |
|---|---|---|
| Zn | | 7.6 to 9.5% |
| Cu | | 1.0 to 1.8% |
| Mg | | 2.4 to 3.5% |
| Cr | | 0.07 to 0.17% |
| Mn | | 0.15 to 0.25% |
| Zr | | 0.08 to 0.14% |
| Fe | ≦ | 0.20% |
| Si | ≦ | 0.15% |
| Ti | ≦ | 0.10% |
| Others each | ≦ | 0.05% |
| Others total | ≦ | 0.15% |
| Remainder | | Al |

(b) homogenizing said billet;

(c) hot extruding said billet to provide a hollow body; and (d) heat treating the extruded hollow body by solution treatment, quenching and artificial ageing ($T_6$ state).

2. The process according to claim 1 including the step of necking one end of the hollow body before the heat treating step.

3. The process according to claim 1 including the step of necking two ends of the hollow body before the heat treating step.

4. The process according to claim 2 wherein the necking is hot necking.

5. The product produced by the process of claim 1, 2, 3, or 4.

6. The process according to claim 3 wherein the necking is hot necking.

7. The product produced by the process of claim 6.

* * * * *